US006203340B1

(12) United States Patent
Yamashita et al.

(10) Patent No.: US 6,203,340 B1
(45) Date of Patent: Mar. 20, 2001

(54) LEVER-TYPE CONNECTOR

(75) Inventors: Kazunori Yamashita; Masamitsu Chishima; Yukinori Saka, all of Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 09/617,443

(22) Filed: Jul. 14, 2000

(30) Foreign Application Priority Data

Jul. 16, 1999 (JP) ..... 11-203119

(51) Int. Cl.[7] ..... H01R 13/62
(52) U.S. Cl. ..... 439/157
(58) Field of Search ..... 439/157, 155, 439/310, 372, 152, 153, 154, 159, 160

(56) References Cited

U.S. PATENT DOCUMENTS 5,330,411 * 7/1994 Fujitani et al. ..... 439/157
5,476,390 12/1995 Taguchi et al. ..... 439/157
5,637,003 7/1997 Takahashi ..... 439/157
5,876,225 * 3/1999 Katsuma et al. ..... 439/157
6,116,928 * 9/2000 Tsuji et al. ..... 439/157

FOREIGN PATENT DOCUMENTS 0 790 676 A2 8/1997 (EP) .

* cited by examiner

*Primary Examiner*—Paula Bradley
*Assistant Examiner*—Tho D. Ta
(74) *Attorney, Agent, or Firm*—Oliff & Berridge, PLC

(57) ABSTRACT

A lever-type electrical connector has connector housings and a lever rotatably mounted on a first connector housing. The lever has a cam track with an entrance end. A cam pin on the second connector housing enters the entrance end of the cam track when the connector housings are brought together with the lever in a waiting position, and by the interaction of the cam pin and the cam track, when thereafter the lever is rotated to a locking position, the connector housings are drawn together into a fully fitted conformation. At least one of the lever and the cam pin has an edge surface inclined with respect to the fitting direction whereby, when the lever is incorrectly located so that the pin is not received in the entrance end of said cam track, the lever and the pin interact at the inclined edge surface to prevent the lever from over-riding the pin.

5 Claims, 8 Drawing Sheets

LEVER-TYPE CONNECTOR

BACKGROUND OF THE INVENTION

1. Field of the Invention

The present invention relates to a lever-type connector, in particular an electrical connector having housings containing electrical elements which are connected when the housings are fitted together.

2. Description of the Related Art

FIGS. 7 through 9 show a conventional lever-type connector. A lever 101 is rotatably supported by a first connector housing 100 which fits into a mating second connector housing 110 in order to make an electrical connection between arrays of terminals in the housings 100,110. Cam pins 111 on the second connector housing 110 engage cam groove 102 of the lever 101. The lever 101 has a pair of plate-shaped arm portions 104, one on each side of the housing, extending to an operation portion 103. The operation portion 103 preferably connects the plate-shaped arm portions 104 together in a substantially rigid manner. This allows the plate-shaped arm portions 104 to more easily be rotated in unison. The cam grooves 102 are formed in the respective arm portions 104.

When fitting the two connector housings 100, 110 to each other, the lever 101 is set in a predetermined waiting posture with the entrance 102A of the cam groove 102 open toward the second connector housing 110. In this state, the connector housings 100, 110 are approached to each other parallel to the surfaces of the arm portions 104 and partially fitted into each other so that the cam pin 111 penetrates into the entrance 102A of the cam groove 102 on each side. The lever 101 is rotated, drawing the connector housings 100, 110 tightly together by a cam action due to the engagement between the cam grooves 102 and the cam pins 111. This kind of lever-type connector is disclosed in JP-A-6-275337.

Let it be supposed that in fitting the connector housings 100, 110 together, the lever 101 is not set at the waiting posture, so that the entrance 102A of the cam groove 102 is not at its position to receive the pin 111. In this case, when the connector housings 100, 110 are approached to each other, the periphery of the cam pin 111 collides with the peripheral edge of the arm portion 104. The operator thus discovers that the lever 101 is located at an inappropriate position. However, if the operator does not notice that the periphery of the cam pin 111 has collided with the peripheral edge of the arm portion 104 and proceeds with the fitting operation forcibly, the arm portion 104 may deform outwardly, thus riding over the cam pin 111. As a result, the arm portions 104 disengage from the peripheral surfaces of the cam pins 111, and the connector housings 100, 110 may be fitted in each other incompletely, with the cam pins 111 and the cam grooves 102 not in engagement with each other, as shown in FIGS. 8 and 9.

U.S. Pat. No. 5,476,390 shows a connector similar to that of FIGS. 7 to 9, in which the cam pins have a chamfer at their extremity, which may tend to encourage over-riding of the lever on the pin.

SUMMARY OF THE INVENTION

It is an object of the present invention to provide a lever-type electrical connector in which it is possible to reliably prevent a pair of connector housings from being fitted to each other when the posture of a lever with its movement range is incorrect.

According to the invention there is provided a lever-type electrical connector including a pair of connector housings adapted to be fitted together to effect electrical connection, and a lever rotatably mounted on a first one of the connector housings for rotation between a waiting position and a locking position, the lever having surfaces defining a cam track. A cam follower is provided on the second of the connector housings in the form of an upstanding member located so as to enter the entrance end of the cam track when the connector housings are brought together in a predetermined fitting direction with the lever in the waiting position. The interaction of the cam follower and the cam track, when thereafter the lever is rotated to the locking position, causes the connector housings to be drawn together into the fitted position. At least one of the lever and the cam follower has an edge surface which is inclined relative to the fitting direction such that, when the lever is at a rotational position such that the cam follower is not correctly received in the entrance end of the cam track, the lever and the cam follower interact at the inclined edge surface to prevent the lever over-riding on the cam follower.

Preferably, the lever has an arm portion in which the cam track is defined, and the cam follower is a pin projecting outwardly from a face of the second connector housing. The arm portion and the pin interact at the inclined edge surface so as to urge the arm portion towards the face of the second connector housing. The pin may have a projecting flange which interacts with the inclined edge surface to urge the arm portion towards the second connector housing.

Alternatively, both the lever and the cam follower have edge surfaces inclined relative to the fitting direction. The two edge surfaces interact to prevent the lever from over-riding the cam follower.

In the connector of the invention, when the two connector housings are brought together, with the lever set in an inappropriate position within its rotation range, the inclined peripheral edge, which is for example on an arm portion of the lever, collides with the cam pin. At this time, the inclined surface subjects the arm portion to a guiding force towards the connector housing, not away from it. Therefore, the arm portion is prevented from being lifted from the cam pin. Thus it is possible to prevent the fitting of the connector housings to each other when the lever is located at an inappropriate position.

It is preferable to make the inclination of the inclined surface gentle to allow the guiding operation of the inclined surface to be performed smoothly. If the tapered surface having a gentle inclination is formed on the cam pin, it may be necessary to increase the diameter of the cam pin, but there are dimensional restrictions in its design. Preferably therefore the inclined surface is formed on the arm portion and can be much larger than on the cam pin. Thus, the inclination of the inclined surface can be set as desired. Preferably this inclination of the inclined surface is at not more than 60°, more preferably not more than 45° relative to the insertion direction.

BRIEF DESCRIPTION OF THE DRAWINGS

Embodiments of the invention will now be described by way of nonlimitative example with reference to the accompanying drawings, in which.

DETAILED DESCRIPTION OF THE PREFERRED EMBODIMENTS

Figure 1:
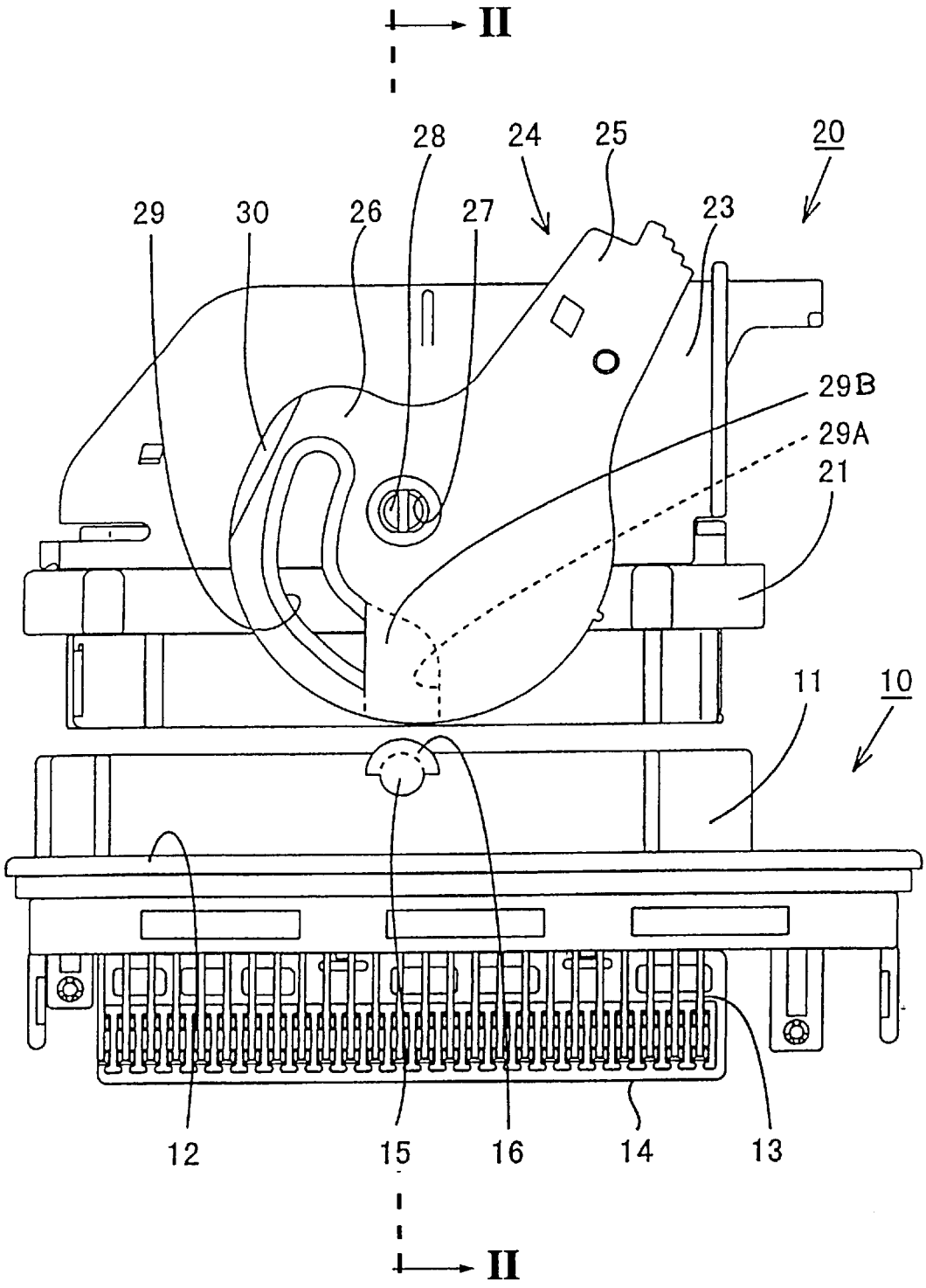
FIG. 1 is a plan view of a connector which is a first embodiment of the invention, showing a state in which two connector housings of the connector are separated from each other.
Figure 2:
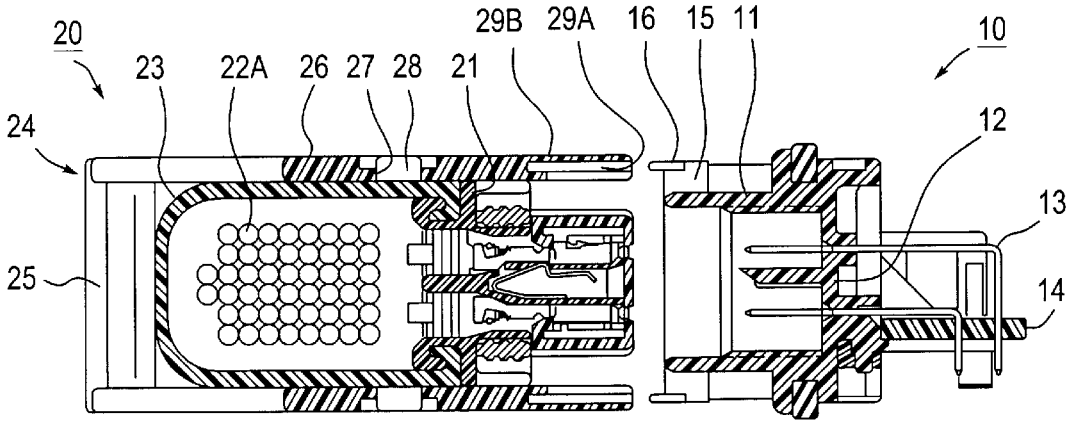
FIG. 2 is a sectional view of the connector of FIG. 1 on line II—II of FIG. 1 showing a state in which the two connector housings are separated from each other.
Figure 3:
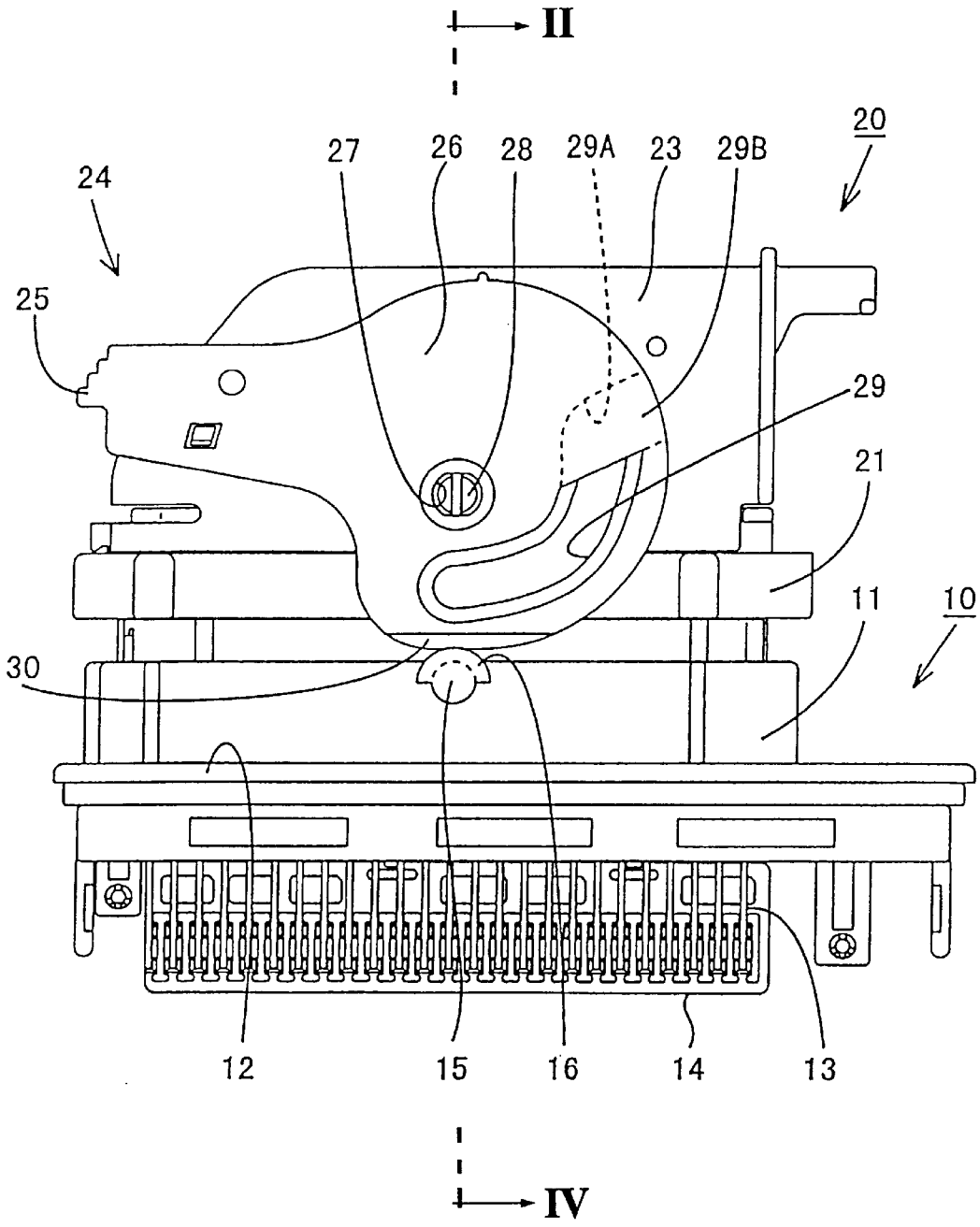
FIG. 3 is a plan view of the connector of FIG. 1 showing a state in which the two connector housings are fitted to each other, with the lever located at an incorrect position.
Figure 4:
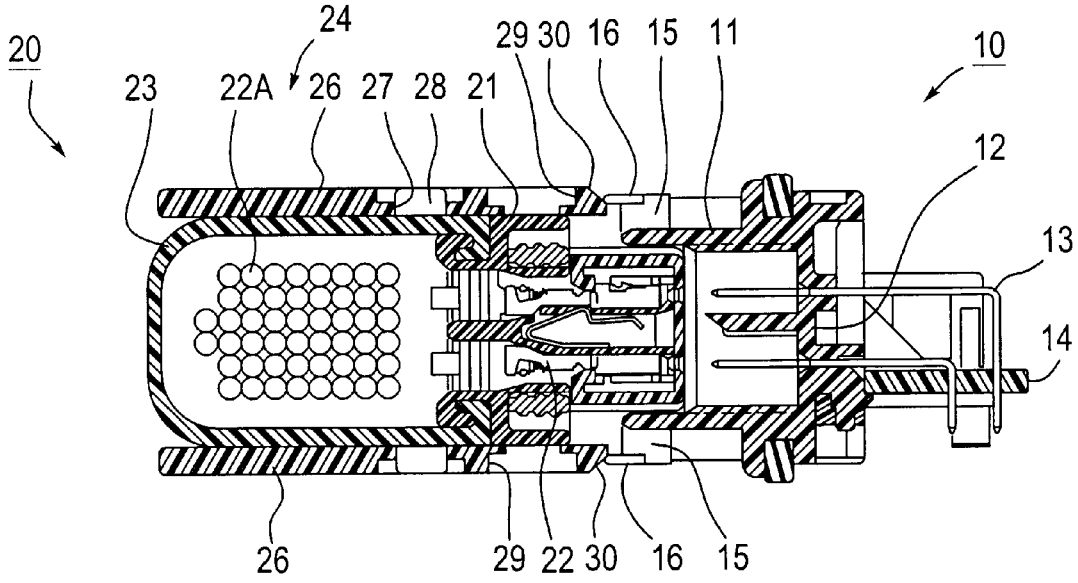
FIG. 4 is a sectional view on line IV—IV of FIG. 3.
Figure 5:
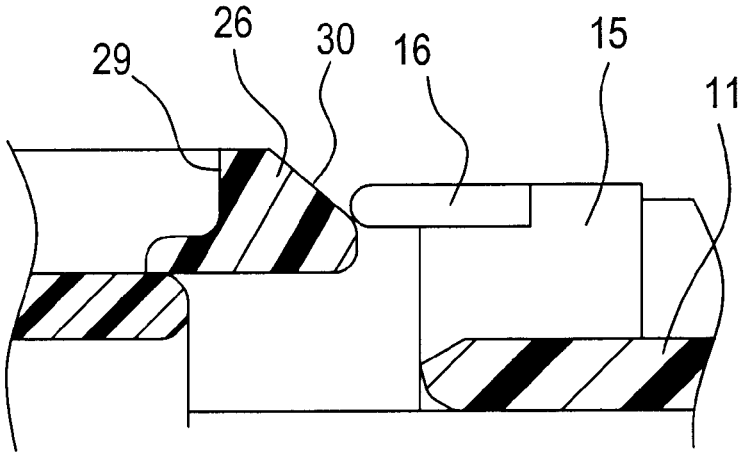
FIG. 5 is a partial enlarged diagrammatic side view showing an arm portion of the lever and a cam pin interfering with each other when the lever is located at the incorrect position.

A lever-type connector which is a first embodiment of the present invention will be described with reference to FIGS. 1 through 5. The connector is composed of a male connector housing 10 and a female connector housing 20 which can be detachably fitted to each other. The male connector housing 10 is for example installed on a circuit substrate (not shown). The male connector housing 10 has a generally rectangular hood portion 11 open in a forward direction and a rear wall portion 12 sealing the rear end of the hood portion 11. L-shaped long and narrow male metal terminal fittings 13 are fixed in and penetrate through the rear wall portion 12. One end of each male metal terminal fitting 13 projects into the hood portion 11, whereas the other end thereof penetrates downward through an alignment plate 14 installed on the housing 10. Cam pins 15 are formed on the upper surface and lower surface of the housing 10. The cam pins 15 are preferably coaxial with each other. As shown in FIG. 5, each cam pin 15 is mainly cylindrical and has a uniform outer diameter in its axial direction. A semi-circular arc-shaped lip or flange 16 of a larger diameter than or main body portion of the cam pin 15 projects outward from the periphery of the top (outer) end of each cam pin 15, and extends around about the half of the periphery of the cam pin 15 so as to be directed towards the female connector housing 20.

The female connector housing 20 has a body 21 accommodating female metal terminal fittings 22, a cover 23 disposed rearwardly from the rear surface of the body 21 and guiding electric wires 22A in a lateral direction, and a lever 24 installed on the cover 23. The lever 24 has a pair of upper and lower planar sheet-like arm portions 26 joined integrally by an operating portion (handle) 25. Force is applied to the operating portion 25 to move the lever 24. The lever 24 is installed on the cover 23 by fitting a spigot or shaft 28 provided on each side of the cover 23 into a bearing hole 27 of the respective arm portion 26. The lever 24 rotates on the shafts 28 between the waiting position shown in FIG. 1 and the fitted position shown in FIG. 3. In the rotation of the lever 24, the arm portions 26 rotate parallel to and close to the outer surface of the body 21 and that of the cover 23. The arm portions 26 are parallel to the mutual fitting direction of the male and female connector housings 10, 20.

A curved cam groove 29 constituting a cam track is formed on each arm portion 26 and extends partially around the shaft 28. The cam groove 29 is open as a slot on both the inner and outer surfaces of the arm portions 26 except at an entrance 29A to the groove which is open at the peripheral edge of the arm portion 26. A reinforcing plate 29B closes over the entrance 29A of the groove 29 at the outer side of the arm portion 26. The peripheral edge of the arm portion 26 adjacent the groove 29 is preferably curved to extend almost parallel to the outer edge of the groove 29.

In fitting the housings 10 and 20 to each other, first the lever 24 is rotated to the waiting position (FIG. 1), so that the entrance 29A of the cam groove 29 confronts the cam pin 15. In this state, the housings 10, 20 are brought together in a direction parallel to the plane of each arm portion 26 and partially fitted to each other so that the cam pins 15 penetrate into the entrances 29A of the two cam grooves 29. Then the lever 24 is rotated, so that the housings 10, 20 are forcibly bought together by the cam action caused by the engagement between the cam grooves 29 and the cam pins 15. When the lever 24 reaches the fitted position, the housings 10, 20 are completely fitted together.

Let it be supposed that the lever 24 is not set at the waiting position, i.e. that the entrance 29A of the cam groove 29 does not confront the cam pin 15 but is displaced laterally from it. In this case, when the housings 10, 20 are brought together, the peripheral surface of the cam pin 15 and the peripheral edge of the arm portion 26 contact each other. It is to be noted that in the case of the conventional lever-type connector, if the connector housings are forcibly brought together, the arm portion deforms and rides over the front-end (upper end) surface of the cam pin. As a result, the connector housings are fitted in each other incompletely.

The lever-type connector of this embodiment of the invention has a structure that prevents the deformation of the arm portion 26. A chamfer or tapered surface 30 is formed on the peripheral edge of each arm portion 26 by forming the outer surface of the arm portion 26 at an inclination with respect to the fitting direction of the housings 10, 20 along a region adjacent the inner end of the groove 29 remote from the groove entrance 29A, i.e. at the location which confronts the pin 15 if the lever 24 is in the fitting position of FIG. 3. This region of the periphery therefore interferes with the cam pin 15 when the lever 24 is located in the fitting position mistakenly, not in the waiting position. The tapered surface 30 contacts the inner-side edge of the lip 16 of the cam pin 15 (side towards the hood 11) as the housings 10, 20 approach each other. Thereafter, force applied to move the housings 10, 20 towards each other acts to displace the peripheral edge of the arm portion 26 inward, i.e. towards the cover 23.

In this way, it is possible to prevent the arm portion 26 from deforming elastically so that it rides over the cam pin 15. The operator is prevented from fitting the housings 10, 20 together in an incorrect or incomplete manner, by the stop action of the engagement of the arm portion 26 and the pin 15. This mis-fitting is easily noticed, so that correct operation of fitting the housings 10, 20 to each other will occur more reliably.

It is preferable to make the inclination of the tapered surface 30 gentle to allow its guiding operation to be performed smoothly. If a tapered surface having a gentle inclination is formed on the cam pin 15, it is necessary to increase the diameter of the cam pin 15, but there are dimensional restrictions in its design. However, in the embodiment, the tapered surface 30 is formed on the arm portion 26, which is much larger than the cam pin 15. Thus, the inclination of the tapered surface 30 can be set as desired.

Figure 6:
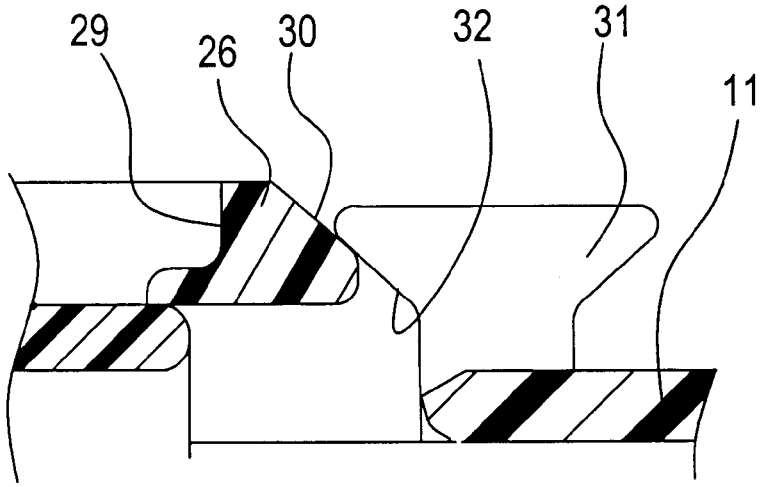
FIG. 6 is a partial diagrammatic view, corresponding to FIG. 5, of the lever and cam pin in a second embodiment of the invention.
Figure 7:
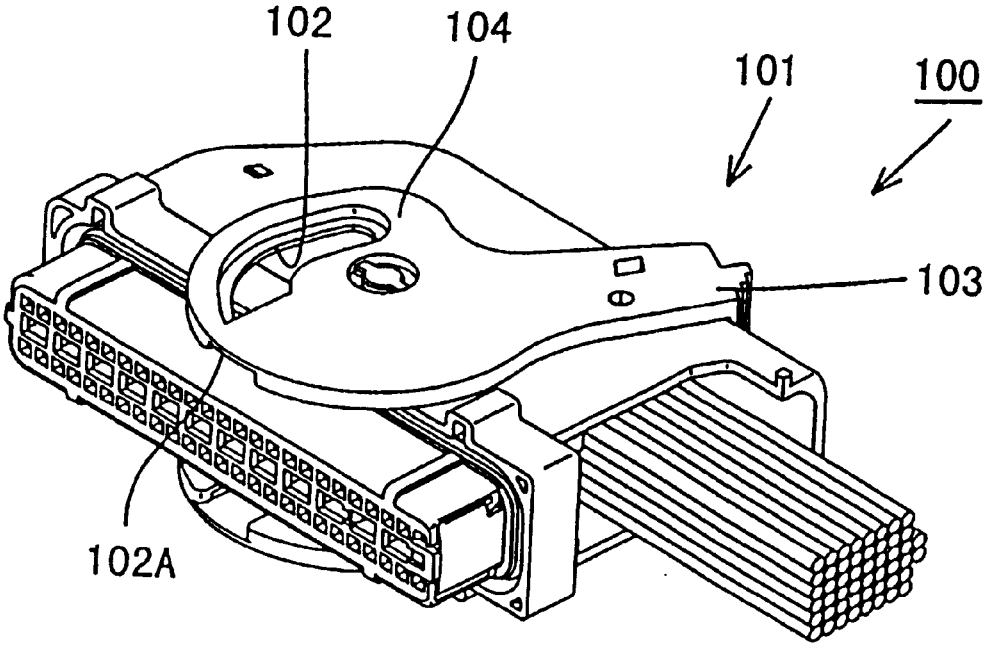
Fig. 7 PRIOR ART
FIG. 7 is a perspective view showing a conventional lever-type connector.
Figure 8:
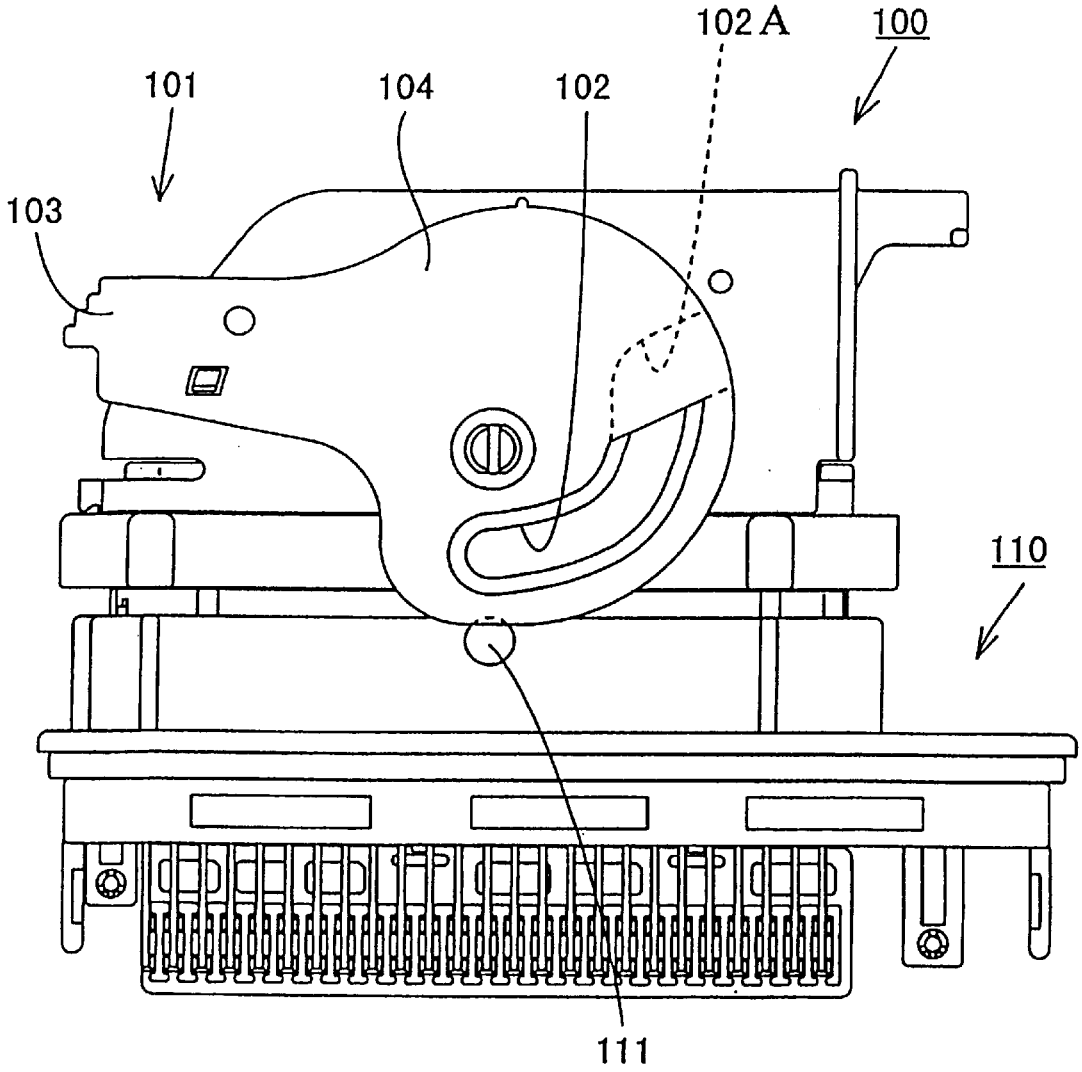
Fig. 8 PRIOR ART
FIG. 8 is a plan view of the connector of FIG. 7.
Figure 9:
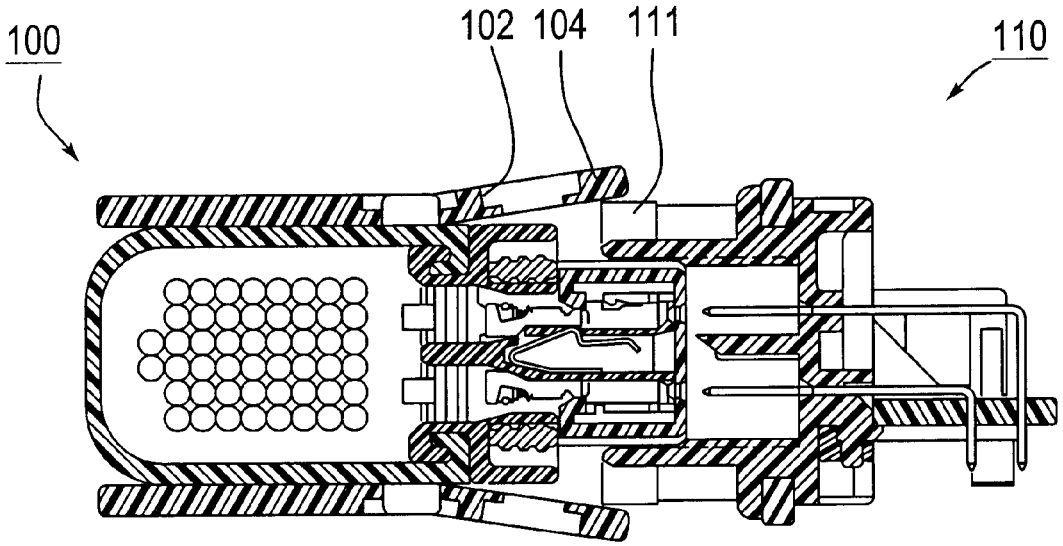
Fig. 9 PRIOR ART
FIG. 9 is a sectional view of the connector of FIG. 7.

A lever-type connector which is a second embodiment of the invention is shown partially in FIG. 6. Only the points on which this embodiment differs from that of FIGS. 1 to 5 are described. In the first embodiment, the tapered surface 30 is formed on only the arm portion 26, whereas in the second embodiment, a tapered surface is formed both on the arm portion and on the cam pin. The cam pin 31 of the second embodiment is tapered so that its diameter increases toward its outer end (upper end in FIG. 6) to form a tapered surface 32 on the underside of the head of the cam pin 31. The lip 16 of FIGS. 1 to 5 is not present. The engagement of the tapered surface with the pin 31 is indicated in FIG. 6.

The present invention is not limited to the above-described embodiments. For example, at least the following variations are included in the technical scope of the present invention.

(1) In the above description, the tapered surface is formed only on the peripheral edge of the arm portion, or on both the arm portion and the cam pin. However, according to the present invention, the tapered surface may be formed on only the cam pin.

(2) In the above description, the lever is formed on the female connector housing. But the lever may be formed on the male connector housing.

(3) In the above description, the lever-type connector is installed on a circuit substrate. Alternatively, the lever-type connector is also applicable to a wire-to-wire type connector.

(4) In the above-described FIGS. 1 through 5, the lip 16 is formed on a semicircular arc region of the cam pin, confronting the male connector housing. However, this lip 16 may be formed on the entire circumference of the cam pin.

(5) In the above description, the tapered surface 30 is formed at only the region that interferes with the cam pin when the lever is located at the fitting position. Within the present invention, the tapered surface may be formed in a wide range such that it interferes with the cam pin when the lever is located at any position between the fitted position and the waiting position.

Although the invention has been described above in relation to particular embodiments, many variations are possible within the spirit and scope of the invention herein described, as will be clear to those skilled in the art.

What is claimed is:

1. A lever-type electrical connector comprising a pair of connector housings that fit together to effect an electrical connection, a lever rotatably mounted on a first one of said connector housings for rotation between a waiting position and a fitted position, said lever having a surface defining a cam track, said cam track having an entrance end, a cam follower provided on a second one of said connector housings, the cam follower being located so as to enter said entrance end of said cam track when said connector housings are brought together in a predetermined fitting direction with said lever in said waiting position, the interaction of said cam follower and said cam track, when thereafter said lever is rotated to said fitted position, causing said connector housings to be drawn together into a fitted state, wherein at least one of said lever and said cam follower has an edge surface which is inclined relative to said fitting direction such that, when said connector housings are brought together, and when said lever is at a rotational position such that said cam follower is not received in said entrance end of said cam track, said lever and said cam follower interact at said edge surface to prevent said lever from over-riding said cam follower.

2. A lever-type electrical connector according to claim 1, wherein each of said lever and said cam follower have said edge surface inclined relative to said fitting direction, said edge surfaces interacting with each other to prevent said lever from over-riding said cam follower.

3. A lever-type electrical connector according to claim 1, wherein said lever has an arm portion in which said cam track is defined and said cam follower is a pin projecting outwardly from a face of said second connector housing, and said arm portion and said pin interact at said edge surface so as to urge said arm portion towards said face of said second connector housing.

4. A lever-type electrical connector according to claim 3, wherein said edge surface is provided on said arm portion.

5. A lever-type electrical connector according to claim 4, wherein said pin has a projecting flange which interacts with said edge surface on said arm portion to urge said arm portion towards said face of said second connector housing.

* * * * *